US010386054B2

(12) United States Patent
Ige

(10) Patent No.: US 10,386,054 B2
(45) Date of Patent: Aug. 20, 2019

(54) DEVICE, METHOD, AND SYSTEM FOR ILLUMINATION OF BOTTLE

(71) Applicant: Leighton Makoto Ige, Kowloon Bay (HK)

(72) Inventor: Leighton Makoto Ige, Kowloon Bay (HK)

(73) Assignee: Sky Capital Technology Limited, Kowloon Bay (HK)

( * ) Notice: Subject to any disclaimer, the term of this patent is extended or adjusted under 35 U.S.C. 154(b) by 0 days.

(21) Appl. No.: 16/053,114

(22) Filed: Aug. 2, 2018

(65) Prior Publication Data

US 2019/0041047 A1 Feb. 7, 2019

Related U.S. Application Data

(60) Provisional application No. 62/591,913, filed on Nov. 29, 2017, provisional application No. 62/540,803, filed on Aug. 3, 2017.

(51) Int. Cl.

| | |
|---|---|
| ***H05B 33/08*** | (2006.01) |
| ***F21V 23/06*** | (2006.01) |
| ***B65D 23/12*** | (2006.01) |
| ***F21V 23/00*** | (2015.01) |
| ***H05B 37/02*** | (2006.01) |
| *F21V 31/00* | (2006.01) |

(Continued)

(52) U.S. Cl.

CPC ..... *F21V 23/06* (2013.01); *B65D 23/12* (2013.01); *F21V 23/003* (2013.01); *H05B 33/0857* (2013.01); *H05B 37/0272* (2013.01); *F21V 31/005* (2013.01); *F21W 2131/40* (2013.01); *F21Y 2115/10* (2016.08)

(58) Field of Classification Search

CPC ..... H05B 33/0815; H05B 33/0818; H05B 33/0884; H05B 33/0809; H05B 33/0848; H05B 33/0896; H05B 37/0245; H05B 37/0254; H05B 33/0863; H05B 33/0872; H05B 33/0803; H05B 37/0272; H05B 33/0857; H05B 33/0887

See application file for complete search history.

(56) References Cited

U.S. PATENT DOCUMENTS 8,567,982 B2 * 10/2013 Zampini, II ..... G06Q 30/0241 315/149

8,814,379 B2 8/2014 Griffiths et al.

(Continued)

FOREIGN PATENT DOCUMENTS

EP 2638784 B1 8/2014

WO WO-2007095569 A2 * 8/2007 ..... A47G 19/2227

*Primary Examiner* — Douglas W Owens
*Assistant Examiner* — Syed M Kaiser
(74) *Attorney, Agent, or Firm* — Thomas C. Cecil

(57) ABSTRACT

A device, system, and method for illumination of a bottle or other vessel. A bottle or vessel may be illuminated using lighting elements disposed in a label that is controlled by a detachable control unit which is configured to sit inside an indentation of the vessel or otherwise below the vessel. The control unit may communicate with other control units and may be configured to display lighting patterns in response to instructions that may be programmed prior to the control unit being attached to the vessel, or in response to instructions sent to the control unit after it has been attached to the vessel.

20 Claims, 8 Drawing Sheets

(51) Int. Cl.
*F21Y 115/10* (2016.01)
*F21W 131/40* (2006.01)

(56) References Cited

U.S. PATENT DOCUMENTS

2007/0284333 A1* 12/2007 Dunnigan ..... B65D 79/02
215/386
2010/0058776 A1* 3/2010 Loibl ..... F25D 31/007
62/3.3
2010/0168878 A1* 7/2010 Hoonhout ..... A61L 9/12
700/90
2015/0284163 A1* 10/2015 Manwani ..... B67D 3/0067
222/105
2018/0042258 A1* 2/2018 Roberts ..... A47J 31/0615
2018/0093814 A1* 4/2018 Espinosa ..... A23L 5/15
2018/0327243 A1* 11/2018 Rider ..... B67D 1/0004

* cited by examiner

DEVICE, METHOD, AND SYSTEM FOR ILLUMINATION OF BOTTLE

CROSS REFERENCES TO RELATED APPLICATIONS

This application claims benefit of priority to U.S. Provisional Patent Application No. 62/540,803 filed Aug. 3, 2017 and entitled "System and Method for Illumination of Bottle" by Ige the disclosure of which is incorporated herein by reference in its entirety, and U.S. Provisional Patent Application No. 62/591,913 filed Nov. 29, 2017 and entitled "System and Method for Illumination of Bottle" by Ige, the disclosure of which is incorporated herein by reference in its entirety.

BACKGROUND OF THE INVENTION

The market for packaging liquor bottles is a competitive one in which distinct brands wish to showcase their marks and attract notice from patrons of a club or store in order to sell product. In darkly lit clubs or stores with low lighting, it can be difficult to read a label, or otherwise a product may not stand out among the other bottles that are featured on a shelf.

To draw attention to a particular bottle or row of bottles in low light situations, some brands have utilized LEDs disposed in the punt of a bottle or electroluminescent (EL) elements placed on the labels.

EL solutions are limited in that they are often restricted to a single configuration which may not be changed once a label has been affixed to a bottle. EL labels are also limited in color ranges due to the properties of the material used to manufacture the EL elements. Furthermore, EL elements cannot blink rapidly, or change color, and they suffer from performance degradation over time.

Some under-bottle LED solutions are problematic because they are limited in what information they can display and how they can display it because of the desire to use simple electronics. Although more complicated electronics may be placed under a bottle to drive a complex display, the complex electronics may be expensive, such that it could not be installed on every bottle without significantly increasing the cost of the solution.

What is needed are electronic devices that may be easily attached and removed from a bottle so that complex electronics may be used affordably. Further, the electronics may support significant customization both before and after deployment so that brands may achieve maximum value once a particular solution has been deployed.

Furthermore, because bottle types may differ slightly in their bottle dimensions across brands and products, a solution is needed which provides for applicability across a number of geometric bottle configurations.

SUMMARY OF THE INVENTION

What is proposed is a modular LED control unit connected to a set of lighting elements such as a thin LED label. The LED label may be constructed and lit so as to prominently display a brand or create other lighting effects, including when lit in combination with other bottles. The modular control unit is reusable in nature—it may be attached to a mount that is specifically designed for a particular bottle type or shape. Further, custom mounts may be designed to adapt the geometry of one type of bottle to a geometry that is appropriately sized and configured to receive a standard-sized modular control unit that may be used across multiple bottle types.

Multiple modular control units may communicate with one another using either proprietary or commonly used communication protocols to coordinate display. Further, control units may be reprogrammed or further controlled by a master control device after they have been deployed. Programming of a modular control unit to respond to a master control device may be achieved in multiple ways, for example, programming the modular control unit with master control device information prior to delivery at a vendor premises, programming the modular control unit by broadcasting program instructions to modular control units by a master control device, or programming the modular control unit by writing information to the modular control unit each time it interfaces with a charging station that is specific to a premises and master control device.

Various sensors and programs may be included in the modular control unit to provide a rich feature set for brands to utilize. For example, the modular units may be responsive to environmental factors including light, sound, and motion. Other programming may be utilized to cause lighting effects independent of environmental conditions, such as timed effects and choregraphed scenes, some of which may be responsive to events such as the purchase of an item or multiple items on the premises.

DETAILED DESCRIPTION OF THE INVENTION

Figure 1:
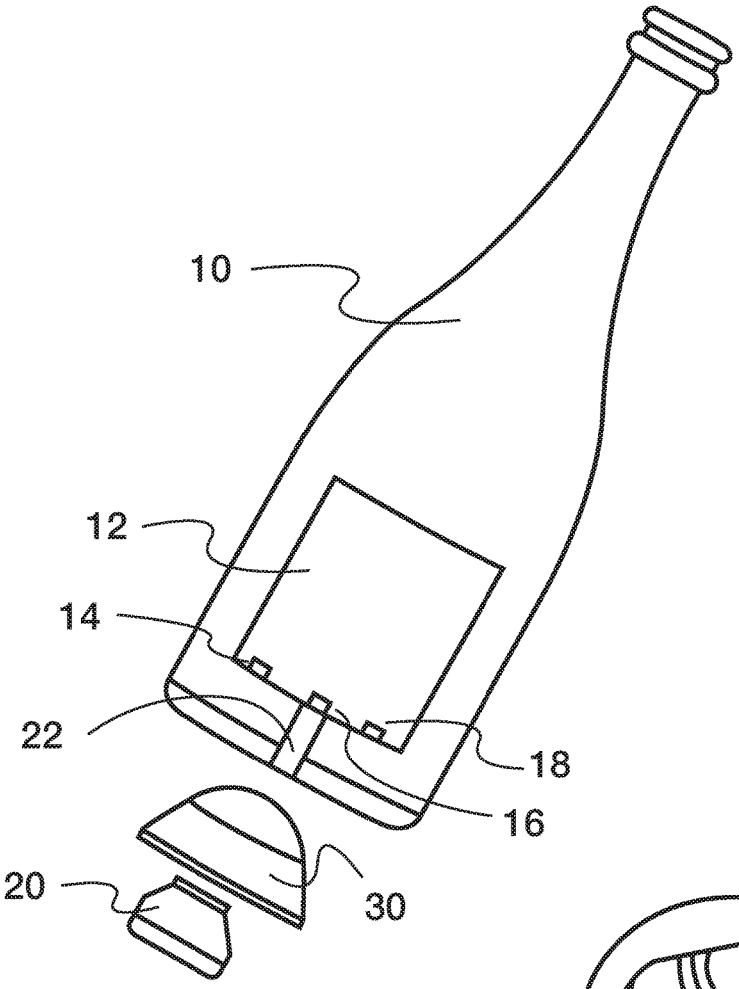
FIG. 1 shows various aspects of modular label system components in accordance with one embodiment.

In one embodiment of the invention, a thin (approx. 1-1.5 mm) piece of translucent plastic is designed in the shape of a traditional wine label to be placed on a bottle 10. One such embodiment is shown in FIG. 1, where label, 12, may be attached to the bottle using a strong adhesive. Label 12 contains LEDs 14, 16, 18, disposed evenly across the bottom edge of the label. The label is coupled to a modular control unit 20 that is stored substantially in the punt of bottle 10. The connection to the modular unit is with thin wiring 22. In one embodiment, wires 22 are a flexible printed circuit (FPC).

In an alternative embodiment wires 22 may contain additional illumination elements. In another alternative, modular control unit 20 may be configured to control LEDs 14-18 wirelessly, utilizing either a proprietary communication protocol or commercially available protocols such as Bluetooth, Zigbee, or WiFi. Although only three LEDs are shown, any number of LEDs may be utilized. Other configurations for placement of LEDs are also possible, such as behind label 12, staggered distribution across the label, and/or along other edges of label 12. Label 12 may be wirelessly connected to modular control unit 20. When the modular control unit 20 directs the LEDs wirelessly, label 12 may be powered by batteries stored within label 12 or may be powered by an inductive power signal originating from modular control unit 20.

Figure 2:
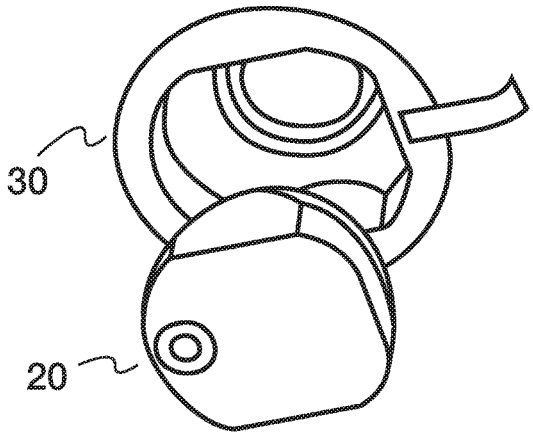
FIG. 2 shows various aspects of the mount housing in accordance with another embodiment.

Label 12 may be connected by wire to a harness 30. Harness 30 is situated inside the punt of bottle 10 and may be composed of a plastic material. Harness 30 is preferably mounted to bottle 10 using an adhesive, but may also be secured using other means, such as a press-fit or through design of the punt to securely hold the harness with snap fitting. As depicted in FIG. 2, harness 30 is designed to receive modular control unit 20 such that modular control unit 20 is removably attached to harness 30 with conductive elements creating electrical connection between the modular control unit and the harness. In an embodiment in which label 12 is directly connected via wire to the modular control unit, harness 30 contains an aperture for the male end of the connector from the modular control unit to the label. In one embodiment, the interface between modular control unit 20 and harness 30 is water-tight (using an o-ring or the like) to allow for the electronics to function while the bottle is submerged in water. Accordingly, in one embodiment modular control unit is water-resistant.

Figure 3:
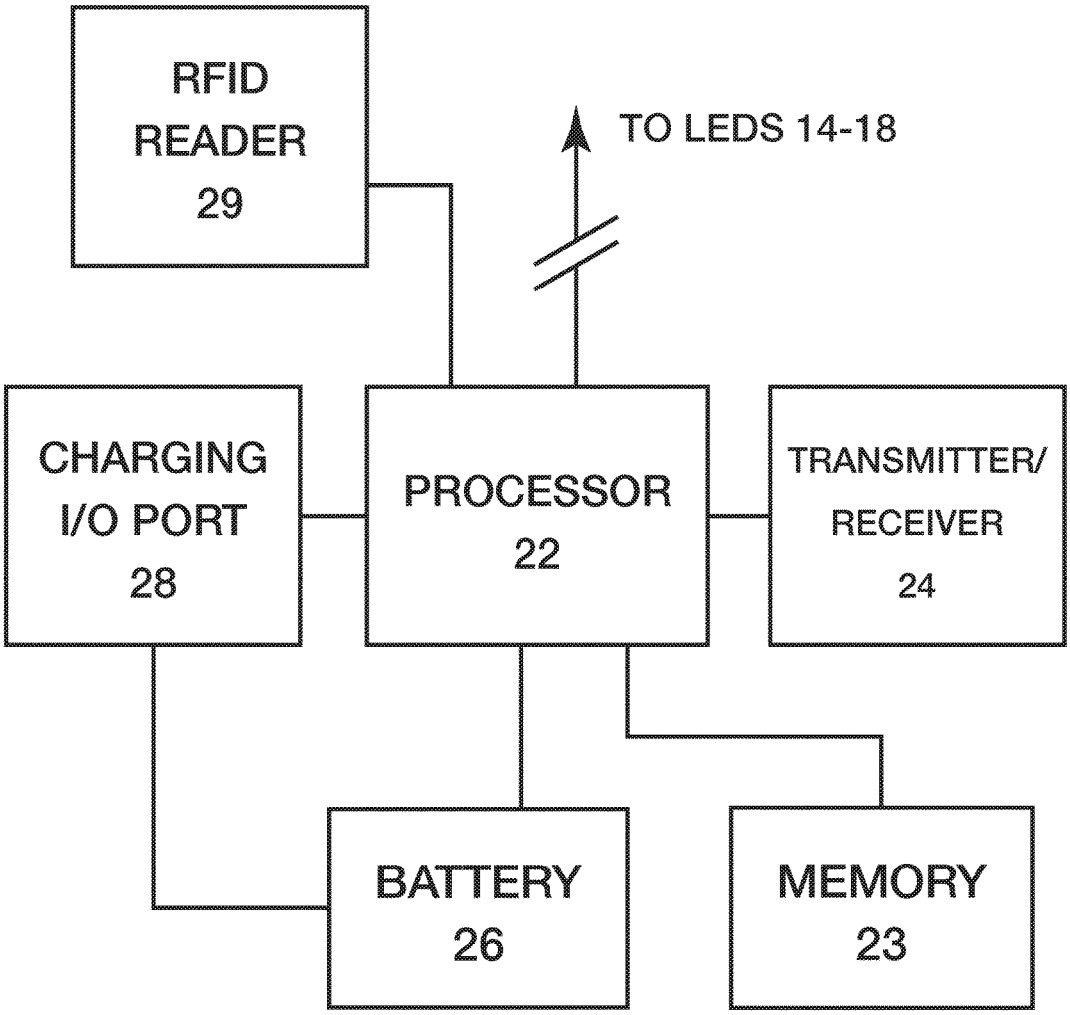
FIG. 3 shows a functional diagram of components within the control unit in accordance with another embodiment.

As shown in FIG. 3, The modular control unit 20 is preferably comprised of power circuitry to power both LED label 12 and modular control unit 20. Modular control unit 20 further comprises a processor 22. The modular control unit may further comprise a communication device 24 (e.g., an RF or other EM transmitter and receiver) for communicating with a master controller. The modular control unit 20 may also communicate with other modular control units. Processor 22 may have internal memory or may additionally be connected to external memory 23. Similarly, transmitter/receiver 24 may be packaged within processor 22. Processor 22 is also connected to battery 26 and charging I/O port. Processor 22 may also be connected to RFID reader 29 which may be utilized in reading RFID information from a harness or other item. Charging I/O port may also be connected directly to battery 26 to enable charging of battery 26.

Figure 4:
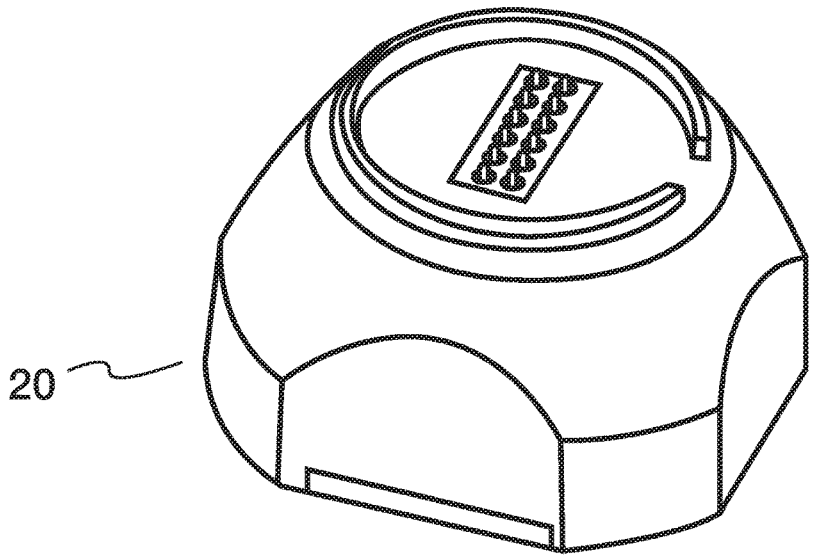
FIG. 4 shows various aspects of the control unit housing in accordance with another embodiment.

In one embodiment, modular control unit 20 is designed to fit fully in the punt of a typical wine bottle. In other embodiments, the modular control unit may be designed to sit underneath the bottle so that it extends beyond the bottom surface of the bottle while still attaching to the harness. As depicted in FIG. 4, in a particular embodiment, modular control unit is conical in shape, approximately 3 cm tall and 4 cm wide at the base, although other smaller configurations are possible. In another embodiment, control unit 20 may attach to the bottom of a bottle with a punt that is shallower than a typical champagne bottle. In one such embodiment, a harness may be used as an adapter to create an interface that allows for control module 20 to be used on bottles with punts of different geometry. In another such embodiment, a harness may be used that allows for additional LED lighting elements to illuminate a bottle with LEDs disposed along the top of the harness or control module. In one embodiment, a harness may be designed to interface with a flat-bottomed bottle.

Microprocessor 22 of modular control unit 20 is configured to control the brightness and color of the LEDs on the label 12. Where LEDs 14-18 are connected directly to the modular control unit, the LEDs are driven by voltages output by microprocessor 22. In other embodiments, for example, when the label is connected to the control unit wirelessly, the label may include additional logic to receive power commands from the control unit.

In another embodiment, other small electronics may be attached to the label. For example, piezoelectric speakers may be used such that sound may be played through the labels.

Processor 22 is preferably a reprogrammable microprocessor chip such as a Nordic nRF52832 Bluetooth Microcontroller. Processor 22 is connected to memory 23 and is further connected to battery 26 which may be a lithium ion or other battery suitable for powering microprocessor and driving LEDs. In one embodiment, processor 22 and LEDs are powered using commonly available low-cost commercial batters such as 'AAA' batteries. Processor 22 may be reprogrammed over the air or may be reprogrammed using battery charging unit (not shown) which connects to charging I/O port 28. Battery charging unit may be wall powered and able to connect to a server system via a wired or wireless network connection such as WiFi or Bluetooth or ZigBee. Processor 22 is also connected to transceiver 24. Transceiver 24 may communicate with other modular control units using a propriety communications protocol or using another commercially available protocol such as Bluetooth or Zigbee or WiFi. In an alternative embodiment, modular control unit 20 may not be equipped with a transceiver and instead may be preprogrammed with any required light driving instructions. In an alternative embodiment, modular control unit elements such as memory 23 and transceiver 24 are incorporated into processor 22.

Figure 5:
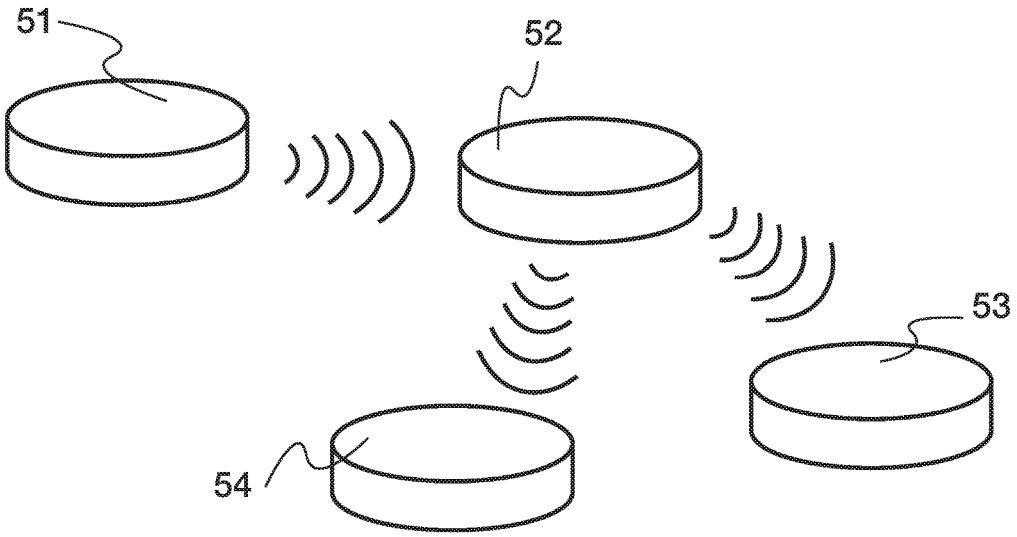
FIG. 5 shows various aspects of a system in which multiple control units communicate with one another in accordance with another embodiment.

As shown in FIG. 5, in one embodiment, multiple modular control units may communicate with one another utilizing retransmission logic. This feature may be utilized so that a single master modular control unit 51 may communicate with multiple other slave devices 52-54. In one embodiment, the master modular control unit 51 dictates to other control units the control schemes that those control units should use to drive their LEDs, including transmission of both color and brightness information. In one embodiment, master modular control unit 51 transmits a pre-programmed sequence to be executed by slave devices 52-54. In another embodiment, master modular control unit 51 actuates LED labels controlled by slave devices in real time by transmission of power commands.

In one embodiment, each slave device is programmed with a unique identifier and a master modular control unit that broadcasts a message that is received by all other modular units. In such a scenario, slave modular control units detect within the transmission instructions which are specific to its module by reviewing data received by the particular slave unit and searching for instructions relative to its unique identifier. In another embodiment, modular control units are each configured with a channel and inspect detected electronic messages to determine whether they are relevant to the modular control unit's channel. In another embodiment, master modular control unit communicates with other units using multiple access methodologies such as time division multiple access or code division multiple access or the like. In such a scenario, data transmitted to slave devices need not have a corresponding unique identifier because a slave device may identify its instructions by identifying the proper timeslot.

Modular control units receiving instructions may receive specific color, brightness, and timing commands. Modular control units may also receive a command to perform a predefined color/brightness combination, sequence, or pattern.

Multiple modular control units may be coordinated so as to provide different color schemes throughout an environment. Units and bottles may be arranged in an array or matrix so that they may be programmed to display characters, images, patterns or messages. For example, in one embodiment, modular control units are programmed to cause illumination in response to detected sounds. In another embodiment, different modular control units are designed to illuminate based on detection of sounds within certain frequency ranges. In one embodiment, multiple modular control units may be arranged in a linear fashion on a rail or plank. In such embodiments, the multiple modular control units are assigned lighting instructions based upon their position relative to other bottles. Other geometric configurations are also possible.

Figure 6:
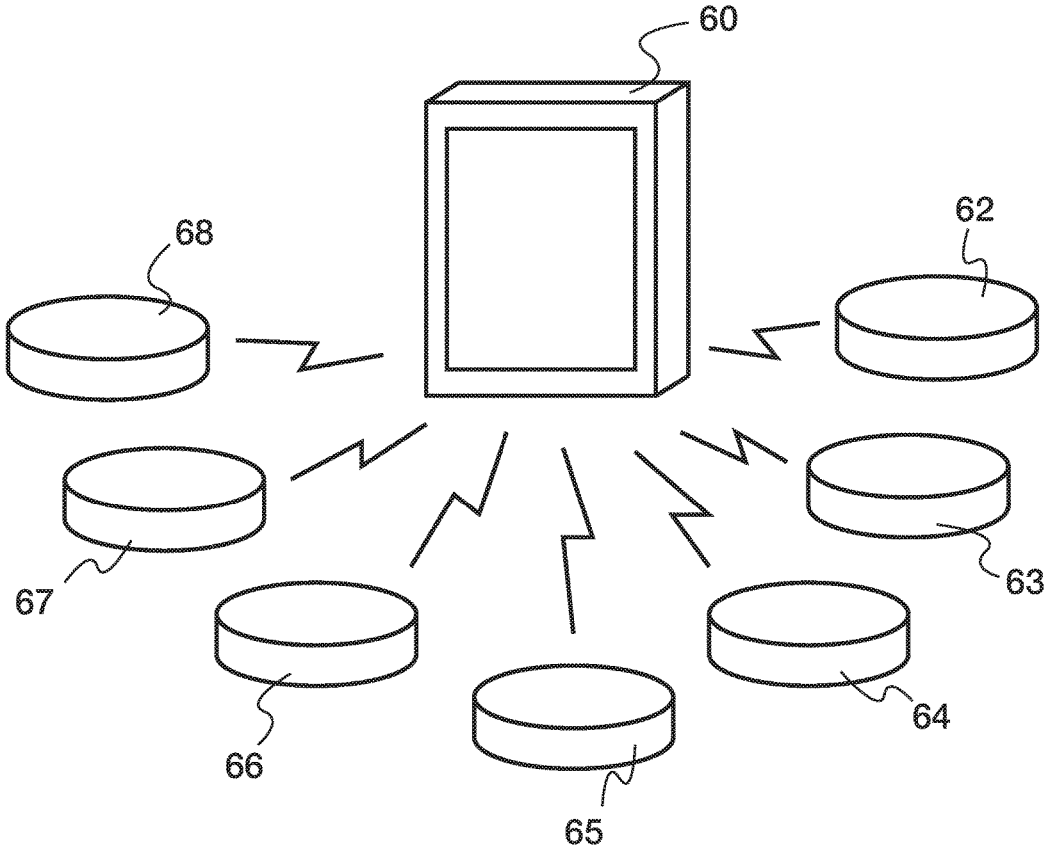
FIG. 6 shows aspects of a system with multiple control units being coordinated by a master control unit in accordance with another embodiment.

As depicted in FIG. 6, in one embodiment, a master communication device 60 serves to communicate with each of multiple modular control units 62-68. For example, master communication device 60 may utilize a common communication protocol, such as Bluetooth, Zigbee, or WiFi and transmit commands to each of modular units 62-68. In another embodiment, master communication device 60 may communicate with modular control units 62-68 using a proprietary communication protocol. In one embodiment, the master communication device can initiate individual two-way communications with each of the modular control units. In this way, the master communication device 60 is able to receive updates from the modular control units regarding conditions such as the functionality of the LEDs or other elements, feedback from sensors (such as light sensors or accelerometers). In one embodiment, once a modular control unit is powered on, the modular control unit will send periodic updates to the master communication device. Such updates may include information about the harness or label that the modular control unit is connected to or other diagnostic information about the modular control unit. In one embodiment, when a modular control unit is first connected to a harness and turned on, modular control unit sends a message to the master control device to indicate the activation of a particular harness or label. The master communication device may give any number of commands to the individual modular control units, including to illuminate lights, or to enter into sleep mode. Master communication device 60 may be able to exert similar control as disclosed for the master modular control unit. For example, modular control units receiving instructions from master communication device 60 may receive specific color, brightness, and timing commands. Modular control units may also receive a command to perform a predefined color/brightness combination, sequence, or pattern. Master communication device 60 may also contain cellular communication capabilities such as a 3G or 4G radio to facilitate access to the master communication device. In such a way, a user may access the master communication device from a remote location to interact with modular control units. Master communication device 60 may also communicate with other consumer devices such as a tablet computer. Master communication device 60 may communicate over several channels and direct communications on to modular control units that are configured to execute commands that are directed to particular channels. Master communication device 60 may be equipped with a transmitter that is sufficiently strong to communicate with modular control units which are located within a particular premises such as a large club, bar, or market.

Although seven modular control units are shown, different numbers of modular control units may be used. In certain embodiments, master communication device 60 may communicate with a subset of modular control units which are group leaders. Group leaders may then communicate with groups of varying sizes.

In one embodiment, master communication device 60 is a portable computing device such as a laptop, tablet, or smartphone. In another embodiment, master communication device 60 is a desktop PC. In one embodiment, master communication device 60 may be programmed with a user application that enables user interaction with individual or multiple modular control units. In another embodiment, a separate communication device such as a PC, laptop, tablet, smartphone, or PC is equipped with a user application that allows for communication with the master communication device 60. The user application supports a rich set of features such as choosing colors, illumination levels, and illumination patterns and sequences. In one embodiment, the user application is programmed to associate a particular song or audio sequence with an illumination pattern or sequence.

In one embodiment, an identification device such as an RFID tag or other microchip is attached to or otherwise included within each harness. Processor 22 may include circuitry 29 to read a unique identifier contained on such identification device. Such information may be gathered by processor 22 once modular control unit 20 is mated with harness 30. Processor 22 may record information related to its connection to harness 30, including for example, date, time, environmental conditions, network conditions, or other data, provided the desired data is available (e.g. location data). Data collected by processor 22 may be transmitted by the processor to another network connected device, including the master communication device 60 or another device configured to receive collected data. In one embodiment, the identification device attached to harness 30 is used in conjunction with modular control unit 20 authenticate that modular control unit 20 is connected to an approved label and to ensure that label is connected to an approved modular control unit. Authentication may occur using symmetric key cryptography, public key cryptography, or another form of secure authentication. Authentication information (including, for example, a serial number) may be sent to the master communication device 60 or to another network connected device or other data collection device. Authentication information may be used in conjunction with or as a substitute for activation information. Improper or failed authentication may result in transmission of a message to a centralized server that records and reports the event, may result in the control module or the LEDs to be at least partially disabled, or may result in other actions designed to encourage proper use of approved labels and modules. In one embodiment, an accelerometer is included in modular control unit 20. After modular control unit 20 is connected to a harness 30, modular control unit may record relevant acceleration events. For example, in an embodiment where bottle 10 is a champagne, modular control unit 20 may record when acceleration occurs that is consistent with a bottle being opened or poured. This information may be recorded and transmitted back to master communication device 60 or to another network connected device or other data collection device.

In one embodiment, an NFC communication unit contained within a modular control unit 20 is used in connection with a mobile phone. The mobile phone may be configured to communicate with the modular control unit and may read ID or configuration form the modular control unit. The mobile phone may also read information from an integrated circuit connected to the label or harness. In such an embodiment, when the modular control unit is connected to the harness, ID or configuration information from the harness or label is communicated from an integrated circuit disposed within the label or harness; such information may then be communicated to the mobile phone using the NFC communication unit in the modular control unit. Sequencing and grouping information may be sent to the modular control unit, as well as other configuration information such as selecting a broadcast channel or a preprogrammed lighting sequence. Other devices other than a mobile phone may be used, including, for example, a tablet device, other PC, or a custom built device.

Figure 7:
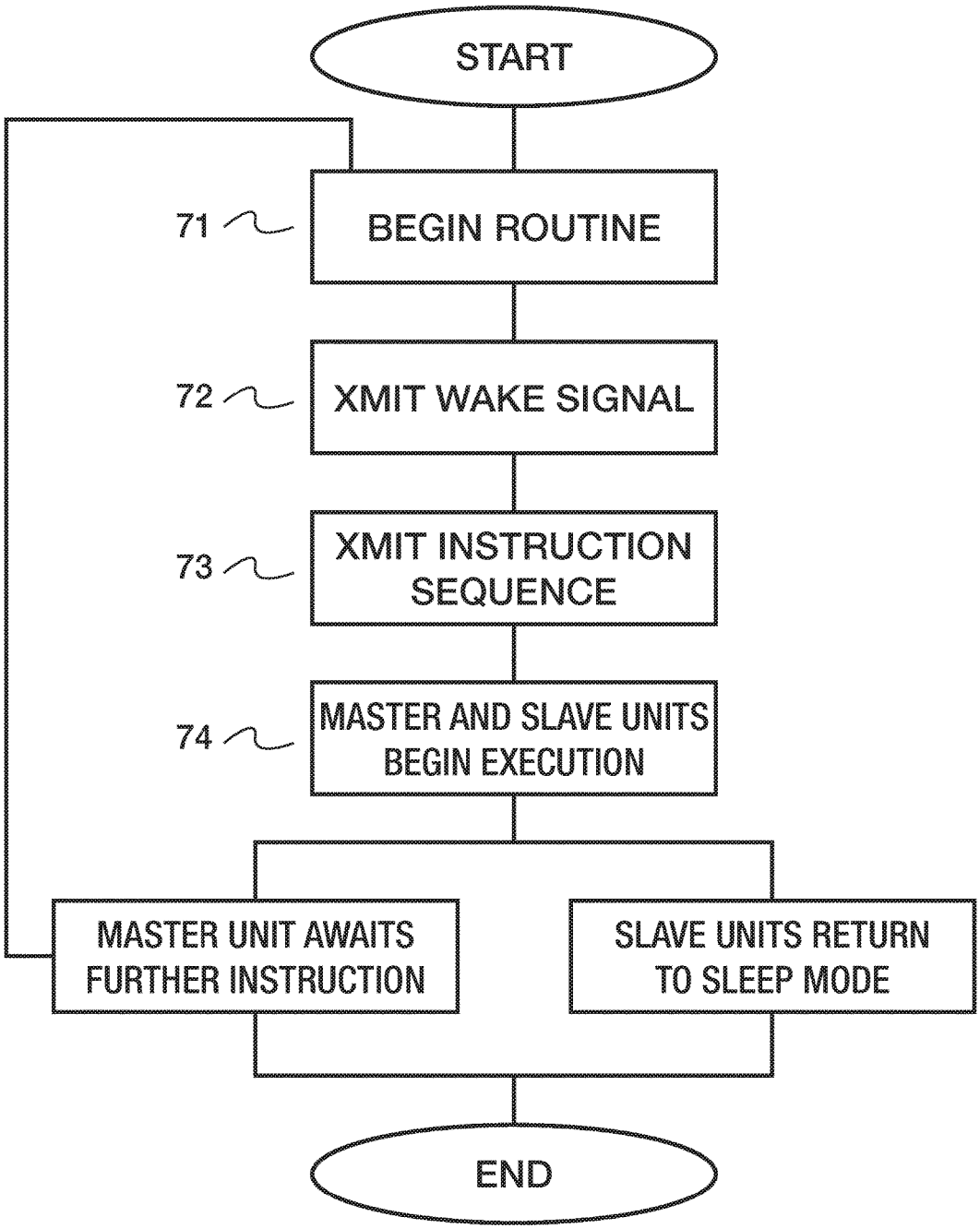
FIG. 7 is a flow diagram illustrating one embodiment of a process for coordinating the displays of several control units.

FIG. 7 is a flow diagram illustrating one embodiment of a process for coordinating the displays of several modular control units. At step 71, a master modular control unit begins execution of a pre-programmed routine. Execution of the routine may be triggered by a command received from an external remote control, a timer, a sound, or other event. At step 72, master control unit transmits a wake signal to slave control units, causing slave control units to enter into active listening mode for receipt of commands. At step 73, master control unit begins transmitting sequence instructions to slave control units. The instructions may contain a predetermined time or countdown timer after which slave control units are to begin execution of their respective instructions. After a predetermined time, at step 74, master control unit begins its illumination sequence, which has been previously programmed to master control unit. At such time, slave control units also begin execution. At step 75, master and slave control units complete execution of pre-programmed sequences. Master control unit awaits further instruction from master communication device, or from instructions pre-programmed in its processor. Slave control units return to sleep mode until they are instructed to wake by master control unit. In another embedment, a pre-programmed routine is transmitted from master communication device 60 to each modular control units 62-68.

In one embodiment, master communication device is coordinated with a point of sale system and programmed to execute certain sequences when certain sales occur. For example, if a vendor at a premises sells a product of a certain type, master communication device may command all modular control devices to execute a blinking pattern, change color, or otherwise display an effect. Alternatively, master communication device may distribute this command to a subset of modular control units. Other events may also trigger the master communication device to transmit sequences to modular control units. For example, when a vendor sells a certain number of a predetermined product, master communication device may command all, or a subset of, modular communication devices to execute a sequence, color change, or effect.

Figure 8:
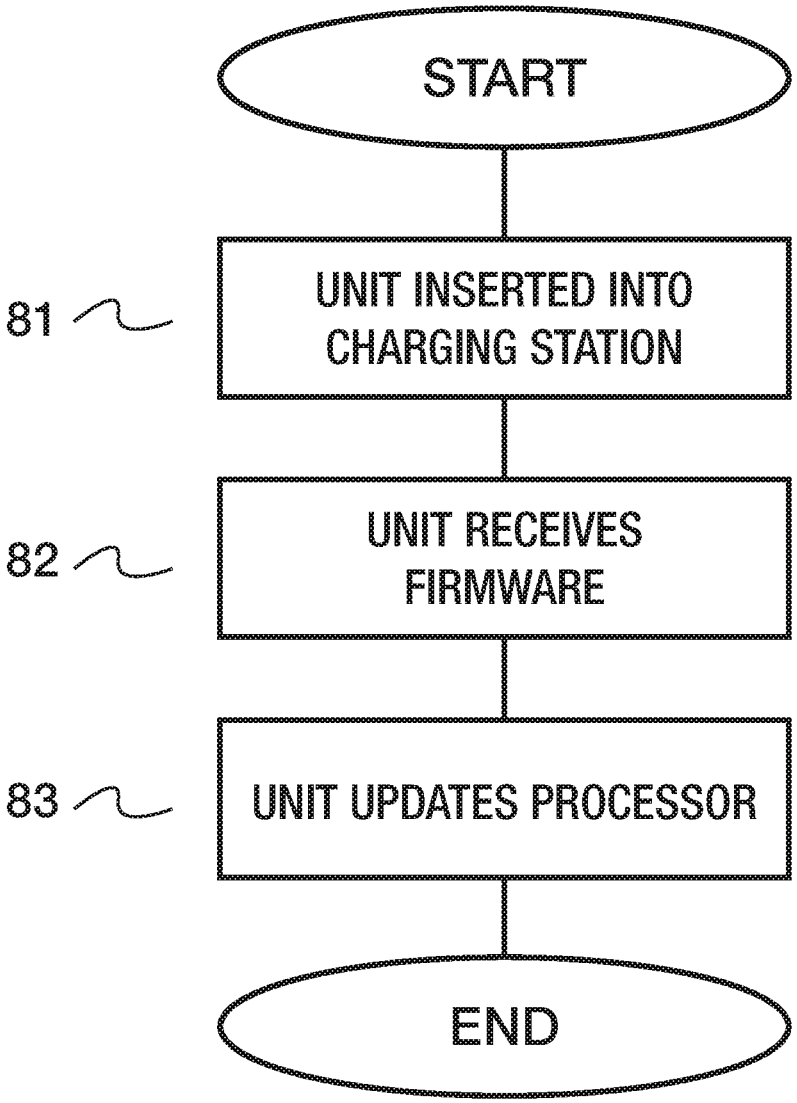
FIG. 8 is a flow diagram illustrating one embodiment of a process for updating firmware of control units.

FIG. 8 is a flow diagram illustrating one embodiment of a process for updating firmware of control units. At step 81, a unit is inserted into a charging station which has received firmware update information from another source. At step 82, the unit begins receiving firmware update instructions from the charging station and updating its processor accordingly at step 83. In one embodiment, a master modular control unit may receive a firmware update, and after receiving its firmware update, the master modular control unit further receives firmware update information for slave control units. Once removed from the charging station, the master modular control unit transmits a wake command to slave units. Master modular control unit then transmits the downloaded slave firmware to slave devices for installation. In an alternative embodiment, one or more slave modular control units may also update their firmware by being attached to the charging station and indicating to the charging station that they are slave modular control devices seeking slave firmware rather than master firmware.

In one embodiment, a charging station is assigned a premises code when the charging station is provided to a vendor or a premises. Each time a modular control unit interfaces with the charging station, the charging station writes the premises code to the control unit. Master communication device 60 is also programmed with the premises code. In one embodiment, master communication device 60 transmits a premises code when communicating commands to modular control units. Only modular control units which have been programmed with the same premises code as the master communication device 60 will respond to commands sent by master communication device. The use of a premises code may be particularly advantageous when multiple communication systems are being operated nearby one another. In certain situations, a particular vendor or premises may be provided with multiple charging stations. Such charging stations may all have a single premises code, or multiple premises codes may be used, allowing for a vendor or premises to sub-divide its control units. For example, in a scenario in which a single geographic facility has multiple clubs, it may be desirable to have a sub-divided premises. In another embodiment, a single charger at a premises may be configured to allow for multiple channels. When a modular control unit interfaces with a charger, the modular control unit would thus be coded with a premises code and a channel code, allowing for control of a group of modular control units at a premises using a single charging unit.

Figure 9:
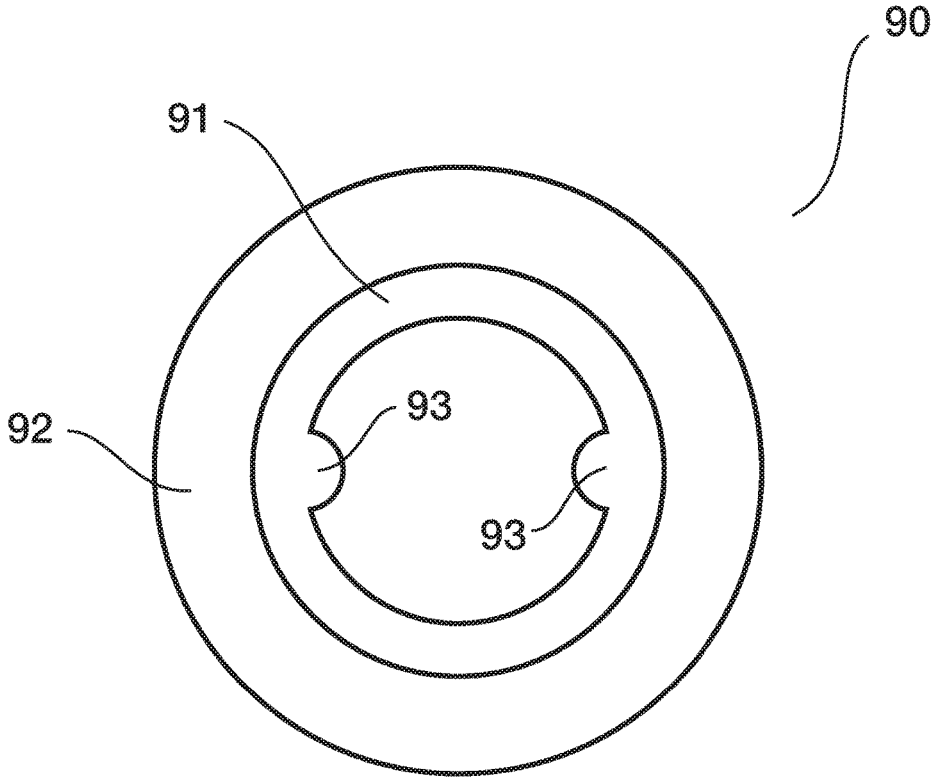
FIG. 9 shows various aspects of a magnetic modular control unit removal device.

In one embodiment, modular control unit 20 contains magnetic material. In order to facilitate removing modular control unit 20 from harness 30, a magnetic removal device 90, as depicted in FIG. 9 may be used. When a bottle with an attached modular control unit 20 is place on top of magnetic removal device 90, modular control unit 20 detaches from harness 30. Magnetic removal device 90 is comprised of magnetic ring 91 and accessory ring 92. In one embodiment accessory ring 92 is composed of plastic, but may be composed of any material. Accessory ring 92 may be branded to provide advertisement for a particular brand. Magnetic ring 91 is substantially circular as depicted, with protrusions 93. Magnetic elements (not shown) are included inside protrusions 93.

In one embodiment, when multiple modules are distributed, they may be managed by a central brand manager. Vendors of a brand who sell particular a product at a premises which houses modules may control the modules using an application that may be installed on a computing device such as a personal computer, tablet, or smartphone. The application is ultimately driven by a management and administrative system that may be controlled by the central brand manager or another with approved access to the management and administrative system.

Each vendor and/or premises may obtain its own account which is used in accessing the application. A brand manager may tailor the look and feel as well as the features available to a location by customizing the application for each such vendor.

In one embodiment, the application provides access to management of the modules located at a particular premises. Access to the application is limited to those with proper credentials, such as a username and password, or other conventionally known access control techniques. In one embodiment the application allows a user to interface with the master control unit. In this way, a user of the application may adjust the illumination levels of individual labels or multiple labels. In another embodiment, the application allows a user to interface with each and every module at a particular premises individually. The application may be configured to allow a user to select and play pre-choreographed music and light shows or to select and display ambient effects. The application may also contain an automatic mode for playing continuous random ambient effects.

The application may be configured to show, within the application user interface, an on-screen preview of a selected lighting effect. The application may also be configured receive new content (such as new preprogrammed sequences) from a management server. In one embodiment, the application may include a feedback messaging system to communicate with technical support representatives or brand management representatives. In another embodiment, the application may operate on one device such as a tablet and be configured to further communicate with other devices such as a smartphone. In such a system, smartphones may be used as subcontrollers to allow for additional customization of an environment.

In one embodiment, the administrative and management system may be used to manage accounts for locations, and different levels of account management hierarchies may be leveraged (for example, regional and global management schemes). The administrative and management system may control access to the application such that it may disable access to a particular account or a particular device upon which the application is operating. The administrative and management system may collect feedback from the use of the application by various users, including tracking of frequency of use and methods of use to determine popularity of various features.

The foregoing detailed description has been given for clearness of understanding only, and no unnecessary limitation should be understood therefrom. While the present invention has been described with reference to preferred embodiments and several alternative embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention therefore shall be defined solely by the claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. A device comprising:

a harness, configured to fit inside a concave indentation formed on an exterior surface of a vessel;

a control module configured to be removably attached to said harness;

a label configured to be affixed to said exterior surface of said vessel; and at least one LED disposed along an edge of said label;

wherein said at least one LED is in communication with said control module via said harness;

wherein said control module comprises:

a microcontroller;

a receiver connected to said microcontroller; and wherein said control module is configured to communicate brightness and color commands to said at least one LED.

2. The device of claim 1 wherein said control module is further configured to receive at said receiver said brightness and color commands from a master communication device.

3. The device of claim 1 wherein said control module is further configured to receive at said receiver a wireless message containing a channel indicator;

determine whether said channel indicator matches a local channel setting; and if said channel indicator matches said local channel setting, process brightness and color commands contained in said wireless message.

4. The device of claim 3 wherein said microcontroller is configured to obtain a local channel setting from a charging device.

5. The device of claim 4 wherein said brightness and color commands are commands common to a plurality of control modules.

6. The device of claim 5 wherein said wireless message is transmitted to said receiver by a master communication device in response to a command sent over a cellular network.

7. The device of claim 5 wherein said wireless message is transmitted to said receiver by a master communication device in response to a predetermined sales event.

8. The device of claim 5, said device further comprising a transmitter;

wherein said transmitter is configured to transmit identification information regarding said harness.

9. The device of claim 8, wherein said transmitter is configured to transmit said identification information periodically after said control module has been attached to said harness and said control module has been powered on.

10. The device of claim 1 wherein said vessel is made of glass.

11. The device of claim 1 wherein said vessel is made of a polymer.

12. A method for illuminating a vessel comprising:

removably attaching a control module to a harness wherein said harness is affixed inside a concave indentation formed on an exterior surface of said vessel and said harness is further connected to at least one LED which is disposed along an edge of a label wherein said label is affixed to said exterior surface of said bottle;

transmitting, from a master communication device, a wireless message intended for said control module, wherein said wireless message contains a channel indicator to be evaluated by said control module to determine whether the channel indicator matches a local channel setting stored on said control module;

wherein said wireless message further contains at least one lighting command configured to cause said control module to illuminate said at least one LED using a particular color and brightness.

13. The method of claim 12 further comprising receiving, at said master communication device, identification information transmitted from said control module.

14. The method of claim 13 wherein said identification information is transmitted by said control module after said control module has been attached to said harness and said control module has been powered on.

15. The method of claim 12 wherein said transmitting of said wireless message by said master communication device occurs in response to a sale of a commercial product.

16. A system for illuminating a plurality of vessels, comprising:

a first control module configured to be removably attached to a first harness configured to fit inside a concave indentation formed on an exterior surface of a first vessel, said first control module further connected to a first label affixed to said exterior surface of said first vessel, said first control module further connected via said first harness to a first at least one LED disposed along an edge of said first label, wherein said first control module is configured to communicate first brightness and color commands to said first at least one LED;

a second control module configured to be removably attached to a second harness configured to fit inside a concave indentation formed on an exterior surface of a second vessel, said second control module further connected to a second label affixed to said exterior surface of said second vessel, said second control module further connected via said second harness to a second at least one LED disposed along an edge of said second label, wherein said second control module is configured to communicate second brightness and color commands to said second at least one LED;

a master communication device configured to transmit a wireless message to said first control module and said second control module, wherein said wireless message contains message data which is converted to said first brightness and color commands by said first control module.

17. The system of claim 16 wherein said data contained in said wireless message is converted to said second brightness and color commands by said second control module.

18. The system of claim 17 wherein said wireless message contains a channel indicator and wherein said second control module converts said message data to said second brightness and color commands only when a local channel setting of said second control module matches said channel indicator.

19. The system of claim of claim 18 wherein said first control module is configured to transmit identification data obtained from said first harness to said master communication device.

20. The system of claim 19 wherein said master communication device transmits said identification data to a central brand server.

* * * * *